US006759991B2

(12) United States Patent
Boyle

(10) Patent No.: US 6,759,991 B2
(45) Date of Patent: Jul. 6, 2004

(54) ANTENNA ARRANGEMENT

(75) Inventor: Kevin R. Boyle, Horsham (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/084,709

(22) Filed: Feb. 25, 2002

(65) Prior Publication Data

US 2002/0126052 A1 Sep. 12, 2002

(30) Foreign Application Priority Data

Mar. 6, 2001 (GB) ..... 0105440

(51) Int. Cl.[7] ..... H01Q 13/08; H01Q 9/36
(52) U.S. Cl. ..... 343/702; 343/746
(58) Field of Search ..... 343/702, 767, 343/700 MS, 846, 848, 725, 729

(56) References Cited

U.S. PATENT DOCUMENTS 6,204,819 B1 3/2001 Hayes et al. ..... 343/702
6,498,586 B2 * 12/2002 Pankinaho ..... 343/700 MS

FOREIGN PATENT DOCUMENTS

| | | | | |
|---|---|---|---|---|
| EP | 0929121 A1 | 7/1999 | ..... | H01Q/13/10 |
| EP | 0997974 A1 | 3/2000 | ..... | H01Q/9/04 |
| EP | 0993070 A1 | 4/2000 | ..... | H01Q/1/38 |
| EP | 1113524 A2 | 7/2001 | ..... | H01Q/21/28 |

OTHER PUBLICATIONS

GB 010009, Filed: Jan. 22, 2002, Ser. No.: 10/055,376, Inventor: Kevin R. Boyle, Entitled: Antenna Arrangement.
GB 000145, Filed Oct. 2, 2001, Ser. No.: 09/969,000, Inventors: Paul R. Marschall et al. Entitled: Transceiver for the Time Division System.
GB 000176, Filed Nov. 30, 2001, Ser. No.: 10/015,707, Inventor: Kevin R. Boyle Enitled: Antenna Arrangement.

Patent Abstracts of Japan, Azuma Keijiro, "Frequency Switch–type Inverted F Antenna," Publication No. 10190345, Jul. 21, 1998, Application No. 08344893, Dec. 25, 1996.

Patent Abstracts of Japan, Iwane Yasushi, "Antenna System," Publication No. 08321716, Mar. 12, 1996, Application No. 07126144, May 25, 1995.

Patent Abstracts of Japan, Ogawa Koichi, "Antenna For Miniaturized Radio Equipment," Publication No. 08274535, Oct. 18, 1996, Application No. 07073376, Mar. 30, 1995.

Patent Abstracts of Japan, Yoda Kiyoshi, "Plate Antenna," Publication No. 04157908, May 29, 1992, Application No. 02285142, Oct. 22, 1990.

Patent Abstracts of Japan, Hayashi Akihiko, "Inverted–F Antenna," Publication No. 2001274619, Oct. 5, 2001, Application No. 2000090737, Mar. 27, 2000.

* cited by examiner

*Primary Examiner*—James Clinger
(74) *Attorney, Agent, or Firm*—Jack D. Slobod; Dicran Halajian

(57) ABSTRACT

An antenna arrangement comprises a patch conductor (102) supported substantially parallel to a ground plane (104). The patch conductor includes first (106) and second (108) connection points, for connection to radio circuitry, and further incorporates a slot (202) between the first and second points. The antenna can be operated in a plurality of modes by variations in the impedances connected to the first and second points. For example, if signals are fed to the first point (106) then a high frequency antenna is obtained by connecting the second point (108) to ground and a low frequency antenna by leaving the second point (108) open circuit. A wide range of embodiments having alternative connection arrangements are possible.

19 Claims, 8 Drawing Sheets

ANTENNA ARRANGEMENT

The present invention relates to an antenna arrangement comprising a substantially planar patch conductor, and to a radio communications apparatus incorporating such an arrangement.

Wireless terminals, such as mobile phone handsets, typically incorporate either an external antenna, such as a normal mode helix or meander line antenna, or an internal antenna, such as a Planar Inverted-F Antenna (PIFA) or similar.

Such antennas are small (relative to a wavelength) and therefore, owing to the fundamental limits of small antennas, narrowband. However, cellular radio communication systems typically have a fractional bandwidth of 10% or more. To achieve such a bandwidth from a PIFA for example requires a considerable volume, there being a direct relationship between the bandwidth of a patch antenna and its volume, but such a volume is not readily available with the current trends towards small handsets. Further, PIFAs become reactive at resonance as the patch height is increased, which is necessary to improve bandwidth.

A further problem occurs when a dual band antenna is required. In this case two resonators are required within the same structure, which means that only part of the available antenna area is used effectively at each frequency. Since the bandwidth of an antenna is related to its size, even more volume is required to provide wideband operation in two bands. An example of such an antenna is disclosed in European patent application EP 0,997,974, in which two PIFA antennas are fed from a common point and share a common shorting pin. The low frequency element is wrapped around the high frequency element, which therefore means that the high frequency element must be small compared to the total antenna size (and therefore narrow band).

Our co-pending unpublished United Kingdom patent application 0101667.4 (Applicant's reference PHGB 010009) discloses a variation on a conventional PIFA in which a slot is introduced in the PIFA between the feed pin and shorting pin. Such an arrangement provided an antenna having substantially improved impedance characteristics while requiring a smaller volume than a conventional PIFA.

An object of the present invention is to provide an improved planar antenna arrangement.

According to a first aspect of the present invention there is provided an antenna arrangement comprising a substantially planar patch conductor, having first and second connection points for connection to radio circuitry and a slot incorporated between the points, and a ground plane, wherein the antenna arrangement operates in a plurality of modes depending on the impedances of the circuitry connected to the first and second connection points.

By varying the impedances connected to the connection points, the current fed into the antenna may follow different routes, thereby providing different modes of operation. The modes may have different resonant frequencies and/or different impedances. The impedances may include short and open circuits, which may be provided by switches or passive circuits. Further connection points may be provided, and the radio circuitry may comprise a distributed diplexer. All of these arrangements have the advantage of enabling a reduced antenna volume compared to a PIFA of equivalent volume by making full use of the patch conductor in all modes.

According to a second aspect of the present invention there is provided a radio communications apparatus including an antenna arrangement made in accordance with the present invention.

The present invention is based upon the recognition, not present in the prior art, that by enabling the impedances connected to points on the patch conductor of a PIFA to be varied, dual-band and multi-band antennas making full use of the patch area in all bands are enabled.

Embodiments of the present invention will now be described, by way of example, with reference to the accompanying drawings, wherein.

In the drawings the same reference numerals have been used to indicate corresponding features.

Figure 1:
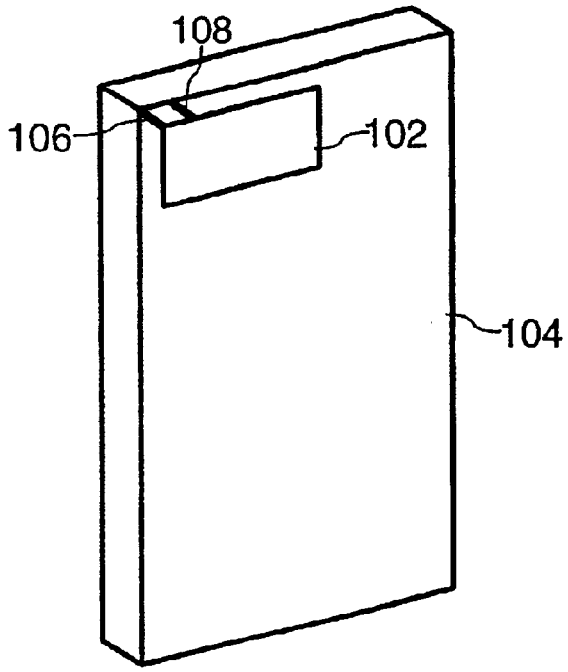
FIG. 1 is a perspective view of a PIFA mounted on a handset.

A perspective view of a PIFA mounted on a handset is shown in FIG. 1. The PIFA comprises a rectangular patch conductor 102 supported parallel to a ground plane 104 forming part of the handset. The antenna is fed via a feed pin 106, and connected to the ground plane 104 by a shorting pin 108.

In a typical example embodiment of a PIFA the patch conductor 102 has dimensions 20×10 mm and is located 8 mm above the ground plane 104 which measures 40×100×1 mm. The feed pin 106 is located at a corner of both the patch conductor 102 and ground plane 104, and the shorting pin 108 is separated from the feed pin 106 by 3 mm.

It is well known that the impedance of a PIFA is inductive. One explanation for this is provided by considering the currents on the feed and shorting pins 106,108 as the sum of differential mode (equal and oppositely directed, non-radiating) and common mode (equally directed, radiating) currents. For the differential mode currents, the feed and shorting pins 106,108 form a short-circuit transmission line, which has an inductive reactance because of its very short length relative to a wavelength (8 mm, or 0.05λ at 2 GHz, in the embodiment shown in FIG. 1).

Figure 2:
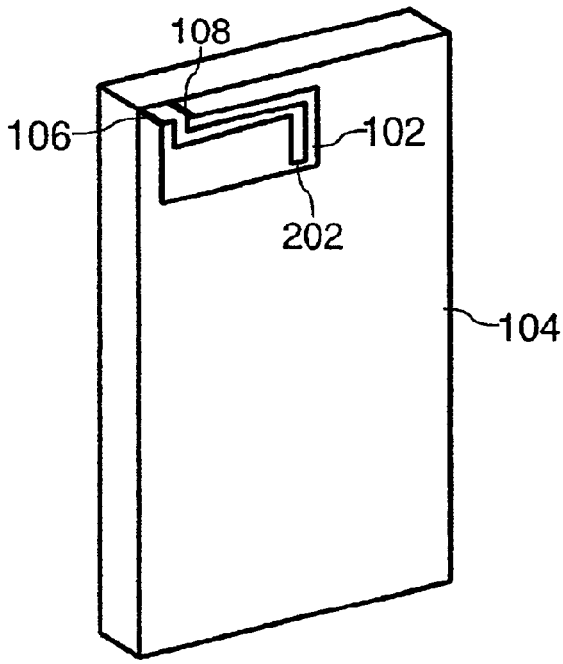
FIG. 2 is a perspective view of a slotted planar antenna mounted on a handset.

FIG. 2 is a perspective view of a variation on the standard PIFA, disclosed in our co-pending unpublished United Kingdom patent application GB0101667.4 (Applicant's reference PHGB 010009), in which a slot 202 is provided in the patch conductor 102 between the feed pin 106 and shorting pin 108. The presence of the slot affects the differential mode impedance of the antenna arrangement by increasing the length of the short circuit transmission line formed by the feed pin 106 and shorting pin 108, which enables the inductive component of the impedance of the antenna to be significantly reduced. This is because the slot 202 greatly increases the length of the short-circuit transmission line formed by the feed and shorting pins 106,108, thereby enabling the impedance of the transmission line to be made less inductive. This arrangement is therefore known as a Differentially Slotted PIFA (DS-PIFA).

It was also shown in the above-referenced patent application that the presence of the slot provides an impedance transformation. This is because the DS-PIFA can be considered to be similar to a very short, heavily top-loaded folded monopole. The impedance transformation is by a factor of approximately four if the slot 202 is centrally located in the patch conductor 102. An asymmetrical arrangement of the slot 202 on the patch conductor 102 can be used to adjust this impedance transformation, enabling the resistive impedance of the antenna to be adjusted for better matching to a 50 Ω circuit.

In a first embodiment of the present invention, the shorting pin 108 is not connected directly to the ground plane 104. Instead, an input signal to the antenna may be fed to either of the pins 106,108, with the other pin either being left open circuit or being connected directly to the ground plane 104. Hence, the pins will now be referred to as a first pin 106 and a second pin 108. As mentioned above, the patch conductor 102 has dimensions 20×10 mm and is located 8 mm above the ground plane 104. The slot 202 is 1 mm wide, starts centrally between the two pins 106,108, then runs parallel to the edge of the patch conductor 102 and 0.5 mm from its edge.

The return loss $S_{11}$ of this embodiment (without matching) was simulated using the High Frequency Structure Simulator (HFSS), available from Ansoft Corporation, for a number of feeding arrangements. In each case, the results are shown as a graph of the magnitude of $S_{11}$ for frequencies f between 800 and 3000 MHz and as a Smith chart illustrating the simulated impedance of the arrangement over the same frequency range.

Figure 3:
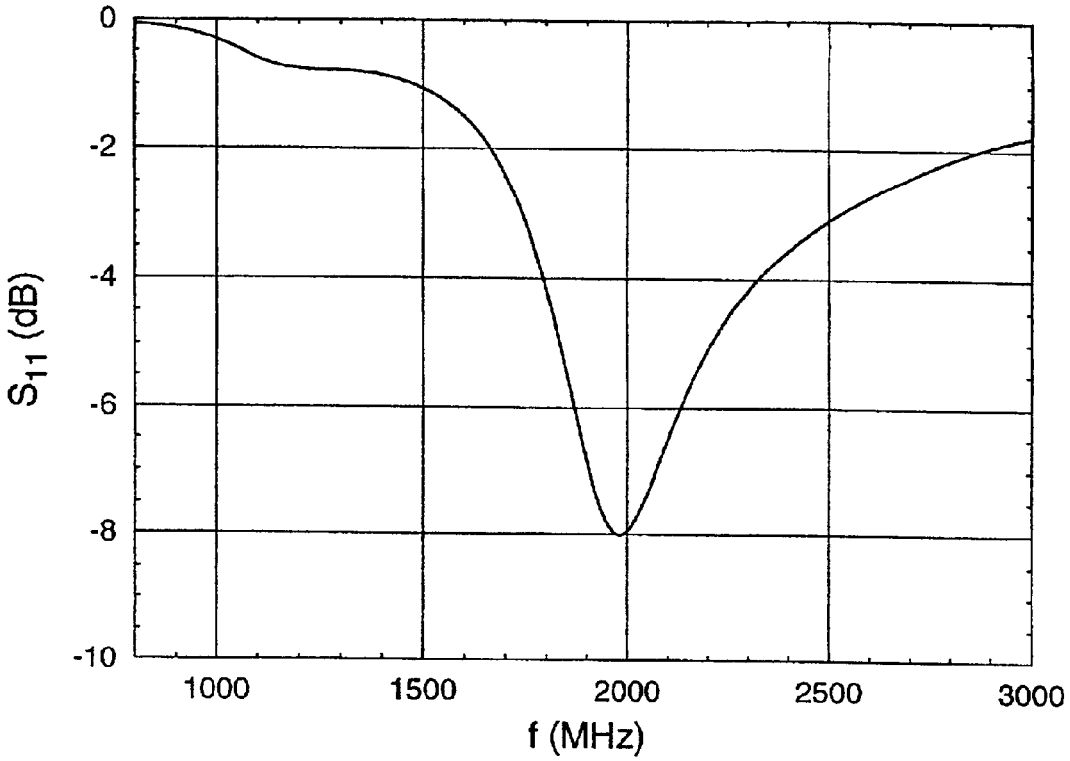
FIG. 3 is a graph of simulated return loss $S_{11}$ in dB against frequency f in MHz for the antenna of FIG. 2, with the first pin fed and the second pin grounded.
Figure 4:
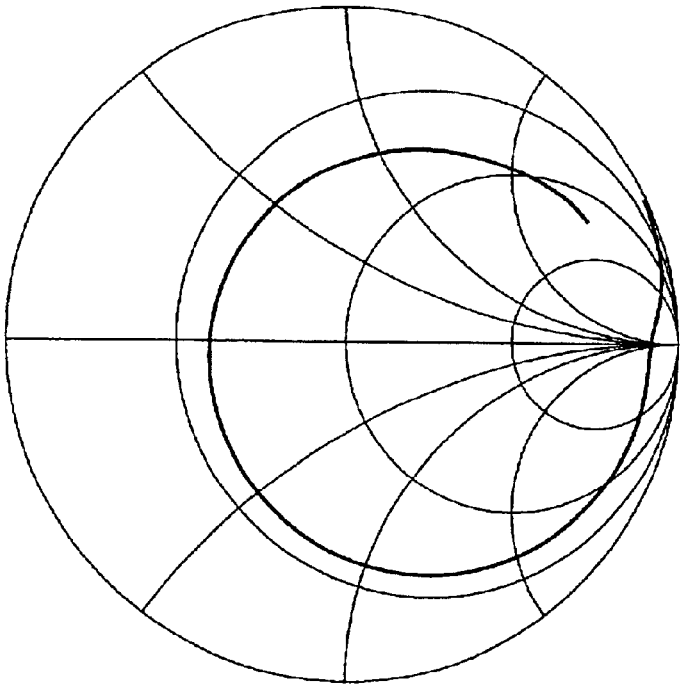
FIG. 4 is a Smith chart showing the simulated impedance of the antenna of FIG. 2 over the frequency range 800 to 3000 MHz, with the first pin fed and the second pin grounded.
Figure 5:
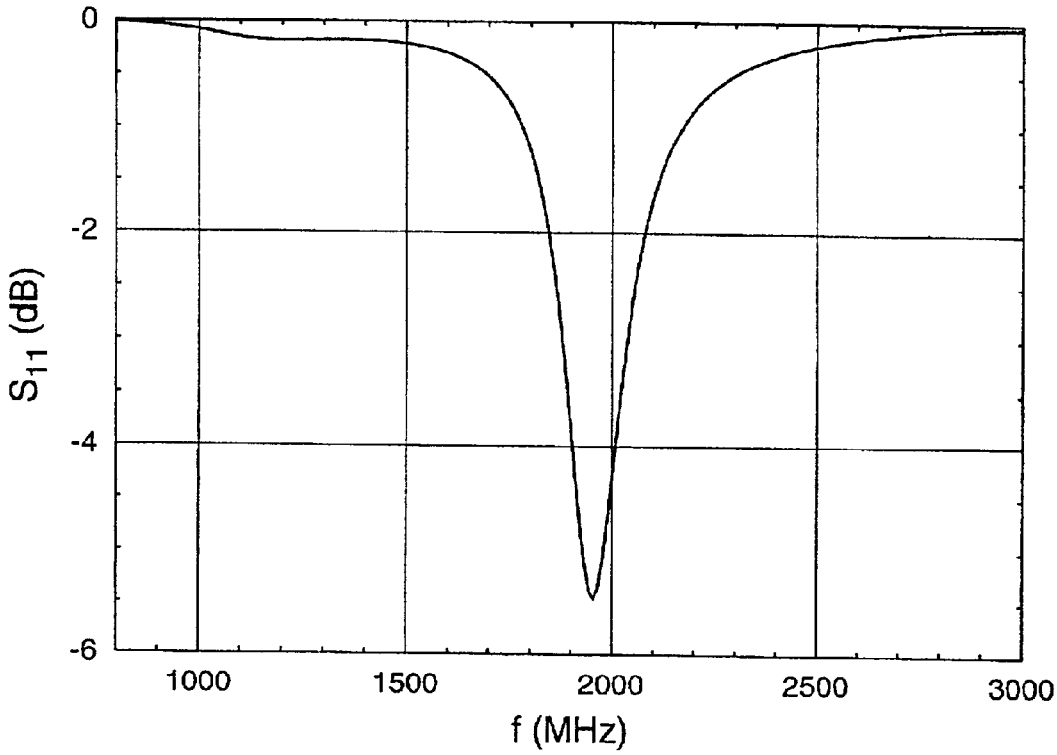
FIG. 5 is a graph of simulated return loss $S_{11}$ in dB against frequency f in MHz for the antenna of FIG. 2, with the second pin fed and the first pin grounded.
Figure 6:
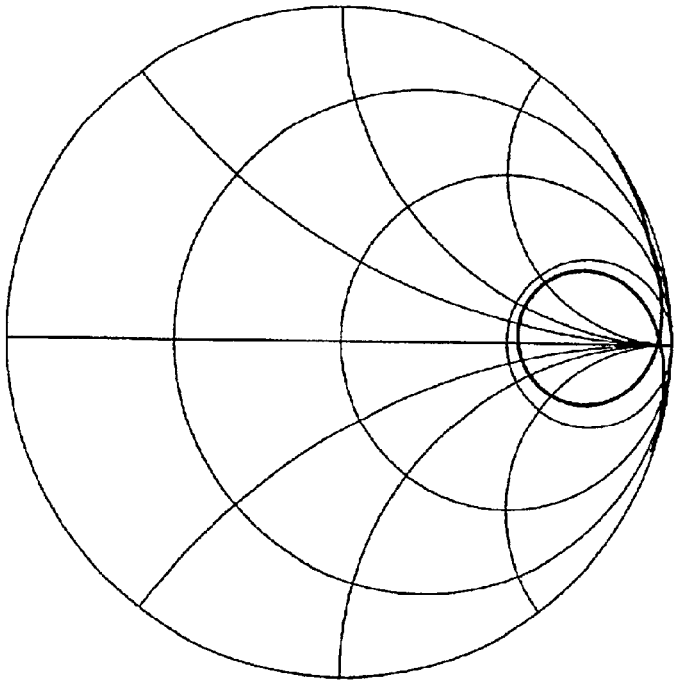
FIG. 6 is a Smith chart showing the simulated impedance of the antenna of FIG. 2 over the frequency range 800 to 3000 MHz, with the second pin fed and the first pin grounded.

In a first arrangement of this embodiment, the first pin 106 is fed while the second pin 108 is shorted to the ground plane 104, with simulation results shown in FIGS. 3 and 4. In a second arrangement, the second pin 108 is fed while the first pin 106 is shorted to the ground plane 104, with simulation results shown in FIGS. 5 and 6. In both of these arrangements, the antenna behaves as a DS-PIFA in the same way as disclosed in GB0101667.4, and is resonant at a high frequency. The impedance presented depends on which side of the slot 202 is fed. When the first pin 106 is fed the common mode transformation ratio is low and a low impedance is presented, while when the second pin 108 is fed the common mode transformation ratio is high and a high impedance is presented. This can clearly be seen from comparison of the Smith charts in FIGS. 4 and 6 respectively.

One way in which the first and second arrangements could be used is disclosed in our co-pending unpublished United Kingdom patent application GB0025709.7 (Applicant's reference PHGB000145) in which a transceiver comprises a transmitter coupled to the first pin 106 and a receiver coupled to the second pin 108 (or vice versa). Such an embodiment can be used in a time division radio system, with circuitry arranged to couple the first pin 106 to the ground plane 104 while the transceiver is receiving and to couple the second pin 108 to the ground plane 104 while the transceiver is transmitting. By suitable positioning of the slot 202, the receiver can be fed by a low impedance while the transmitter can feed a high impedance, improving operation of the transceiver.

Further embodiments could be based on the inclusion of additional features, as disclosed in our co-pending unpublished United Kingdom patent application GB0030741.3 (Applicant's reference PHGB000176), for example the addition of discrete components to the antenna structure.

Figure 7:
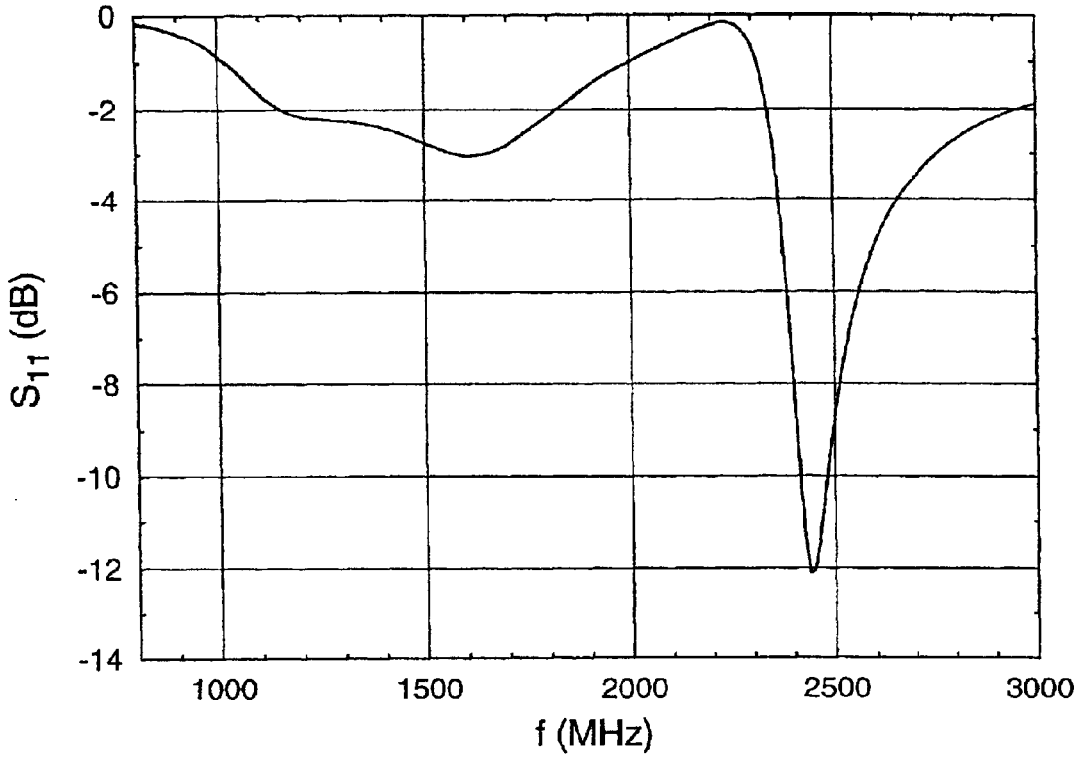
FIG. 7 is a graph of simulated return loss $S_{11}$ in dB against frequency f in MHz for the antenna of FIG. 2, with the first pin fed and the second pin open circuit.
Figure 8:
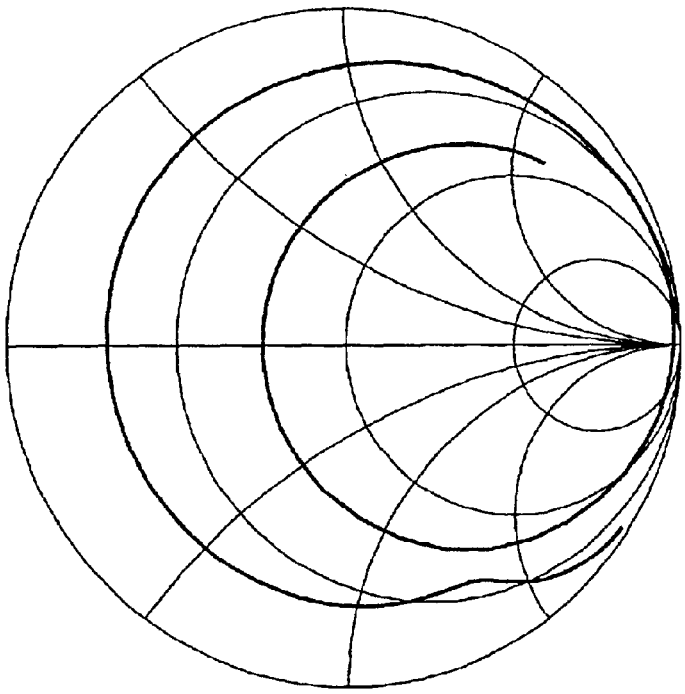
FIG. 8 is a Smith chart showing the simulated impedance of the antenna of FIG. 2 over the frequency range 800 to 3000 MHz, with the first pin fed and the second pin open circuit.
Figure 9:
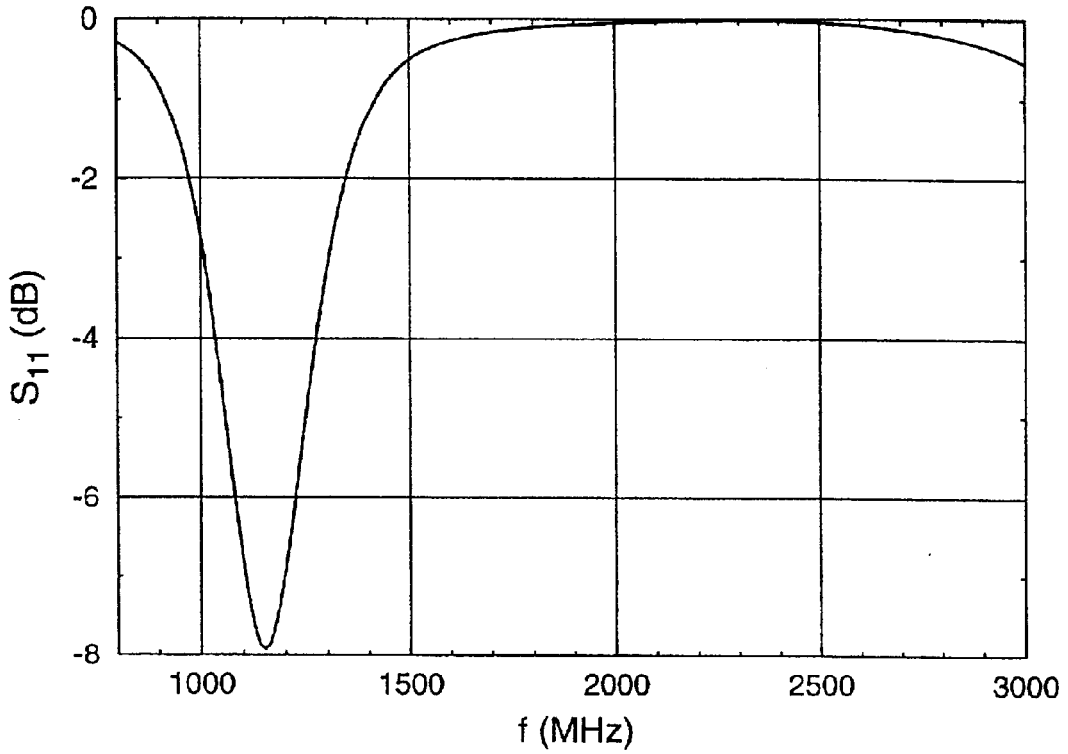
FIG. 9 is a graph of simulated return loss $S_{11}$ in dB against frequency f in MHz for the antenna of FIG. 2, with the second pin fed and the first pin open circuit.
Figure 10:
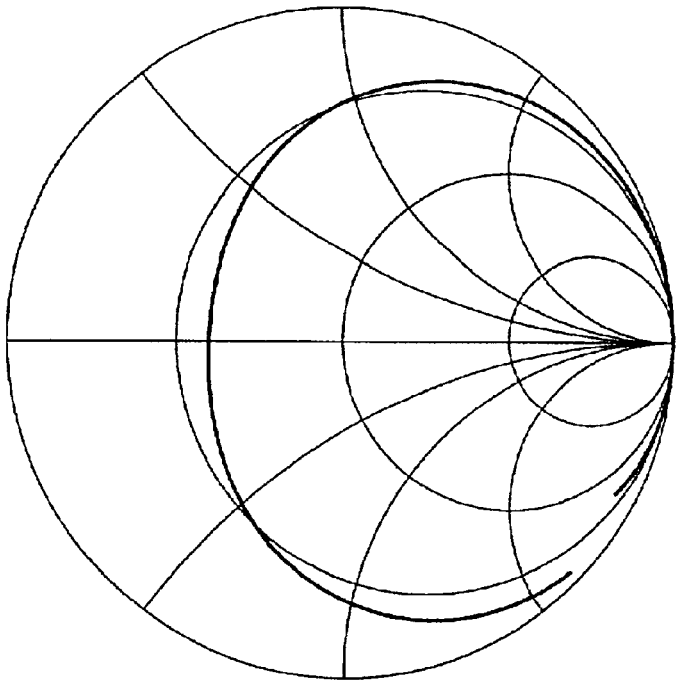
FIG. 10 is a Smith chart showing the simulated impedance of the antenna of FIG. 2 over the frequency range 800 to 3000 MHz, with the second pin fed and the first pin open circuit.

In a third arrangement of the present invention, the first pin 106 is fed and the second pin 108 is left open circuit, with simulation results shown in FIGS. 7 and 8. In a fourth arrangement of the present invention, the second pin 108 is fed and the first pin 106 is left open circuit, with simulation results shown in FIGS. 9 and 10.

It is shown in our co-pending unpublished United Kingdom patent application GB0105441.0 (Applicant's reference PHGB010033), that a Planar lnverted-L Antenna (PILA) together with an external matching circuit can provide equivalent performance to a dual-band or multi-band PIFA from a reduced antenna volume. This is because the shorting pin in a conventional PIFA performs a matching function, but this match is only effective at one frequency and is at the expense of the match at other frequencies.

The third and fourth arrangements operate as a meandered PILA, since the open circuit pin has little effect. In the third arrangement, where the first pin 106 is fed, the resonant frequency is increased because the narrow section of the patch conductor 102, above and to the right of the slot 202, has little effect because of its small area. In the fourth arrangement, the resonant frequency is reduced because the narrow section of the patch conductor 102 carries current to the wider section, and therefore the full meandered length is resonant.

The simulations described above demonstrate that it is possible to operate a planar antenna in both DS-PIFA and meandered PILA modes. A meandered PIFA could also be used instead of a meandered PILA, as in some of the subsequent embodiments. A range of embodiments of the present invention, all suitable for use as a dual band GSM/DCS antenna, will now be presented to illustrate its practical application.

Figure 11:
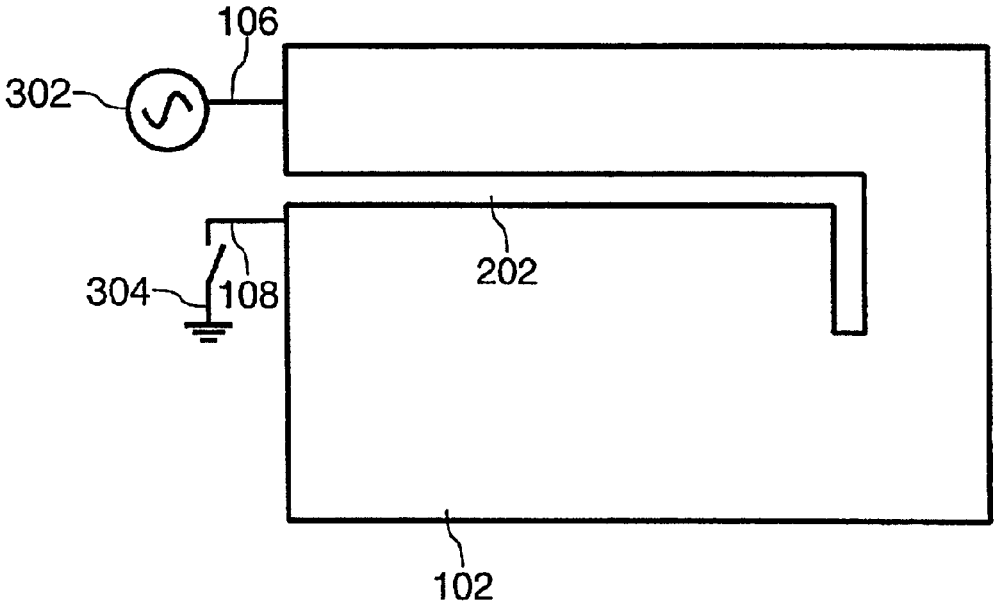
FIGS. 11 to 15 are plan views of further embodiments of the present invention.

FIG. 11 is a plan view of a second embodiment of the present invention. In both bands a RF signal source 302 is fed to the patch conductor 102 via the first pin 106. The second pin 108 is connected to a switch 304. In the low frequency (GSM) mode the switch 304 is open and the antenna operates as a meandered PILA. In the high frequency (DCS) mode the switch 304 is closed, connecting the second pin 108 to the ground plane 104, and the antenna operates as a DS-PIFA. In both modes, all of the antenna structure is used (in contrast to dual-band PIFAs such as that disclosed in EP 0,997,974) and therefore increased bandwidths can be produced. This is particularly beneficial for the high frequency band, and will be even more so for UMTS antennas, which need to operate at a higher frequency and over a wider bandwidth.

Figure 12:
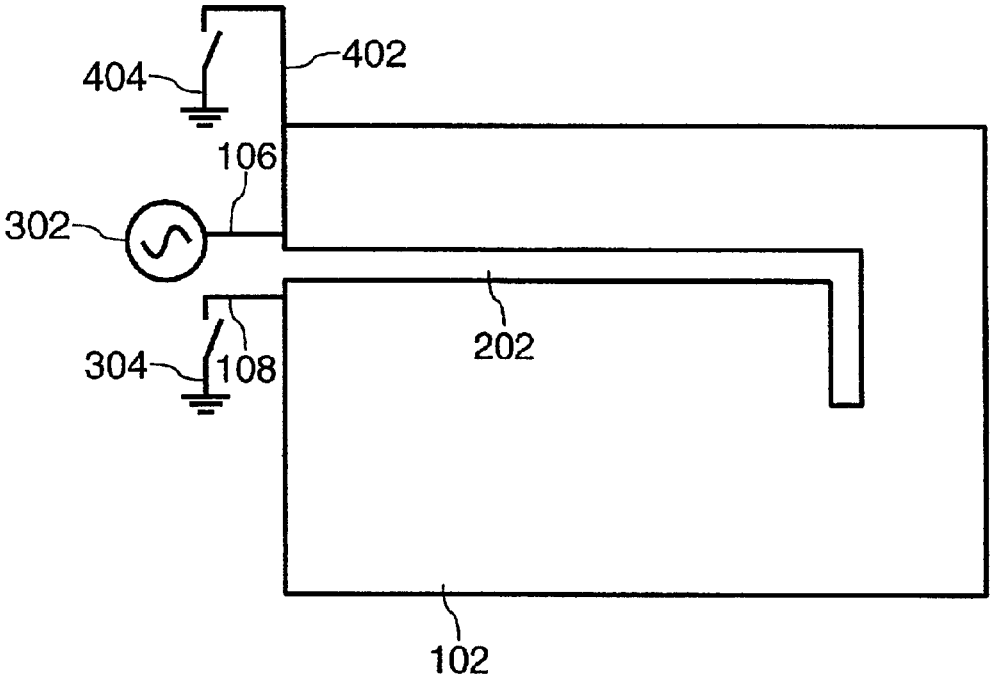

FIG. 12 is a plan view of a third embodiment of the present invention. In both bands a RF signal source 302 is fed to the patch conductor 102 via the first pin 106. The second pin 108 is connected to a first switch 304, and a third pin 402 is provided, connected to a second switch 404. In the low frequency (GSM) mode the first switch 304 is open, the second switch 404 is closed, connecting the third pin 402 to the ground plane 104, and the antenna operates as a meandered PIFA. In the high frequency (DCS) mode the switches 304,404 are reversed, connecting the second pin 108 to the ground plane 104, and the antenna operates as a DS-PIFA.

Figure 13:
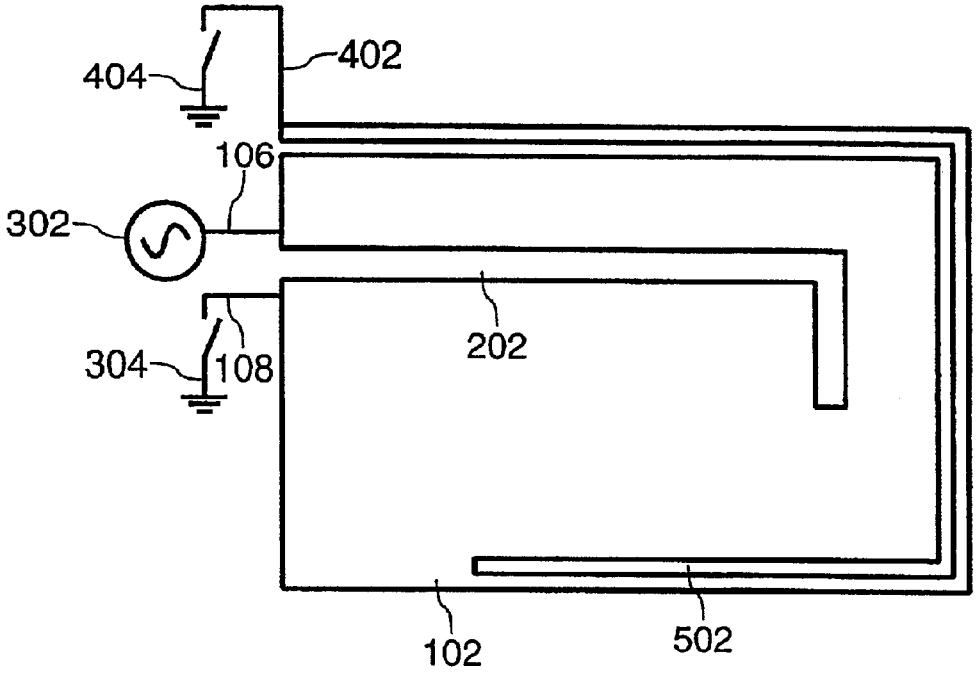

FIG. 13 is a plan view of a fourth embodiment of the present invention. This is the same as the third embodiment with the addition of a further slot 502 close to the edge of the patch conductor 102. The settings of the switches for the modes are the same as for the third embodiment. The presence of the further slot 502 enables the low frequency mode to operate as a DS-PIFA, with a consequent improvement in its match. The high frequency mode is not significantly affected by the further slot 502 owing to its location close to the perimeter of the patch conductor 102.

In all of the above embodiments where switches are used, the same effect could be obtained by other means. For example, passive equivalents such as tuned circuits may be used. In addition, some or all of the pins not being fed could be reactively loaded instead of being short or open circuited.

Figure 14:
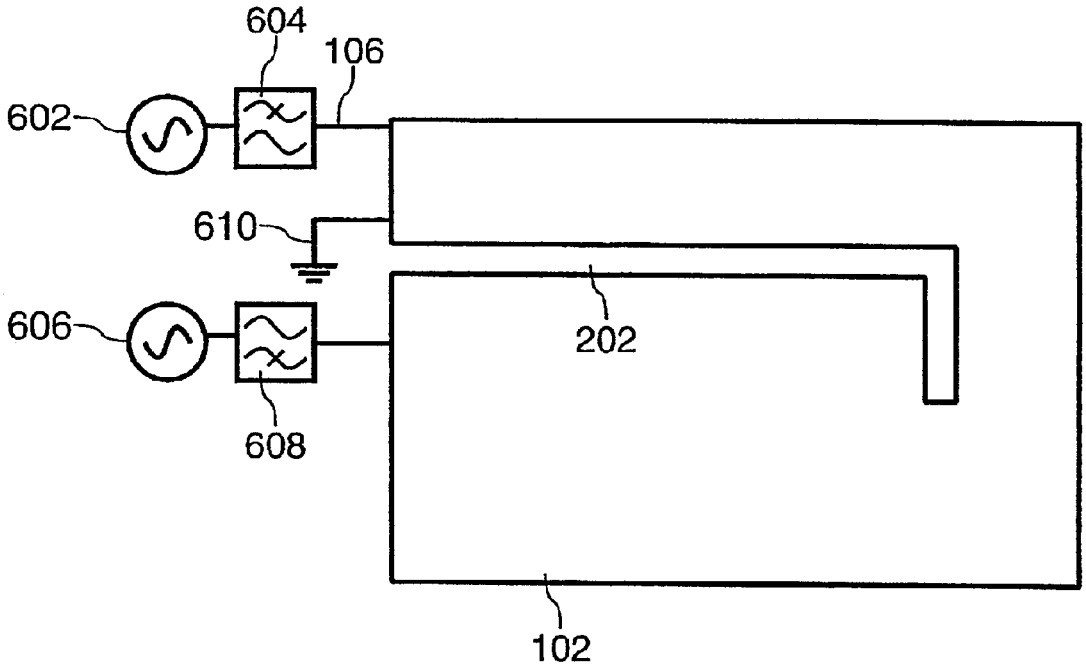

FIG. 14 is a plan view of a fifth embodiment of the present invention, which requires no switching components by distributing a diplexer between two antenna feeds. In the low frequency (GSM) mode, a GSM signal source 602 is passed by a low-pass filter 604 and fed to the patch conductor 102 via the first pin 106. In the high frequency (DCS) mode, a DCS signal source 606 is passed by a high-pass filter 608 and fed to the patch conductor via the second pin 108. A grounding pin 610 is also provided, connecting the patch conductor 102 and ground plane 104. In operation, in the low frequency mode the high-pass filter 608 presents a high impedance to GSM signals and the antenna operates as a meandered PIFA. In the high frequency mode the low-pass filter 604 presents a high impedance to DCS signals and the antenna operates as a DS-PIFA. This embodiment has the additional advantage that the antenna provides additional isolation between the GSM and DCS ports.

Figure 15:
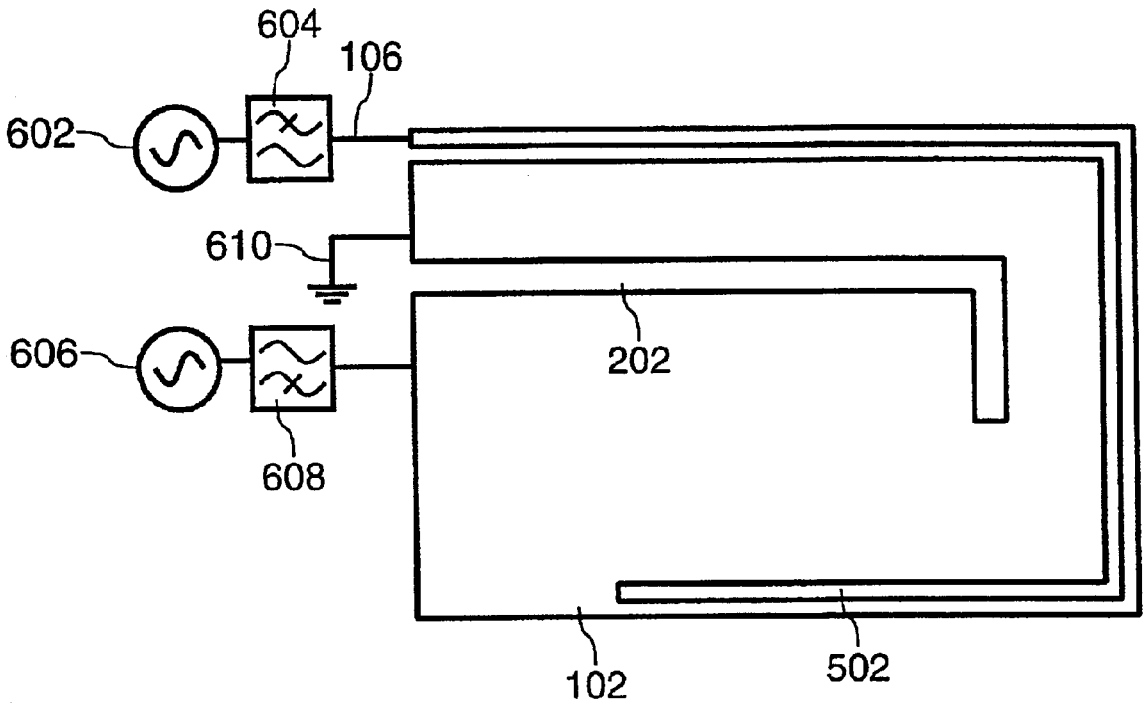

FIG. 15 is a plan view of a sixth embodiment of the present invention. This is the same as the fifth embodiment with the addition of a further slot 502 close to the edge of the patch conductor 102. This modifies the low frequency mode to operate as a DS-PIFA, providing improved impedance characteristics.

From reading the present disclosure, other modifications will be apparent to persons skilled in the art. Such modifications may involve other features which are already known in the design, manufacture and use of antenna arrangements and component parts thereof, and which may be used instead of or in addition to features already described herein.

In the present specification and claims the word "a" or "an" preceding an element does not exclude the presence of a plurality of such elements. Further, the word "comprising" does not exclude the presence of other elements or steps than those listed.

What is claimed is:

1. An antenna arrangement, comprising:

a planar patch conductor including a slot dividing said planar patch conductor into a first section and a second section, said first section being larger than said second section;

a first radio circuit connected to said first section at a feed connection point; and a second radio circuit connected to said second section at a ground connection point, wherein said second radio circuit includes at least one ala switch and a passive circuit for operating said antenna arrangement in a plurality of modes.

2. The antenna arrangement of claim 1, wherein said slot is between said feed connection point and said ground connection point.

3. An antenna arrangement, comprising:

a planar patch conductor including a first slot dividing said planar patch conductor into a first section and a second section;

a first radio circuit connected to said first section at a feed connection point;

a second radio circuit connected to said first section at a first ground connection point; and a third radio circuit connected to said second section at a second ground connection point.

4. The antenna arrangement of claim 3, wherein said first slot asymmetrically divides said planar patch conductor.

5. The antenna arrangement of claim 4, where said first section is smaller than said second section.

6. The antenna arrangement of claim 3, wherein said second radio circuit includes at least one of a switch and a passive circuit for operating said antenna arrangement in a plurality of modes.

7. The antenna arrangement of claim 3, wherein said third radio circuit includes at least one of a switch and a passive circuit for operating said antenna arrangement in a plurality of modes.

8. The antenna arrangement of claim 3, wherein said first slot is between die first ground connection point and the second ground connection point.

9. An antenna arrangement, comprising:

a planar patch conductor including a first slot dividing said planar patch conductor into a first section and a second section;

a first radio circuit connected to said a feed connection point;

a second radio circuit connected to said first section at a first ground connection point; and a third radio circuit connected to said second section at a second ground connection point, wherein said planar patch conductor further includes a second slot dividing said first section into a third section having the feed connection point and a fourth section having die first ground connection point.

10. The antenna arrangement of claim 9, wherein said second slot is between the feed connection point and the first ground connection point.

11. An antenna arrangement, comprising:

a planar patch conductor including a first slat dividing said planar patch conductor into a first section and a second section a first radio circuit connected to said lint section at a first feed connection point;

a second radio circuit connected to said first section at a ground connection point; and a third radio circuit connected to said second section at a second feed connection point.

12. The antenna arrangement of claim 11, wherein said first slot asymmetrically divides said planar patch conductor.

13. The antenna arrangement of claim 12, where said first section is smaller than said second section.

14. The antenna arrangement of claim 11, wherein said first radio circuit includes a first filter.

15. The antenna arrangement of claim 14, wherein said third radio circuit includes a second liter.

16. The antenna arrangement of claim 11, wherein said first radio circuit includes a high-pass filter; and wherein said third radio circuit includes a low-pass filter.

17. The antenna arrangement of claim 11, wherein said first slot is between the first feed connection point and the second feed connection point.

18. An antenna arrangement, comprising:

a planar patch conductor including a first slot dividing said planar notch conductor into a first section and a second section;

a first radio circuit connected to said first section at a first feed connection point;

a second radio circuit connected to said first section at a ground connection point; and a third radio circuit connected to said second section at a second feed connection point, wherein sad planar parch conductor further includes a second slot dividing said first section into a third section having the first feed connection point and a fourth section having the ground connection point.

19. The antenna arrangement of claim 18, wherein said second slot is between the first feed connection point and the ground connection point.

* * * * *